US005495730A

United States Patent [19]

Meeker et al.

[11] Patent Number: 5,495,730

[45] Date of Patent: Mar. 5, 1996

[54] ADAPTER FOR USING A HORIZONTAL PACKAGE DYEING CARRIER WITH A VERTICAL TREATMENT MACHINE

[75] Inventors: Matthew A. Meeker; James K. Turner; Thomas W. Van Scyoc, all of Stanley, N.C.

[73] Assignee: Gaston County Dyeing Machine Company, Stanley, N.C.

[21] Appl. No.: 263,046

[22] Filed: Jun. 21, 1994

Related U.S. Application Data

[63] Continuation-in-part of Ser. No. 49,835, Apr. 19, 1993, Pat. No. 5,410,892.

[51] Int. Cl.[6] ..... D06B 5/06

[52] U.S. Cl. ..... 68/10; 68/198; 68/189

[58] Field of Search ..... 68/189, 198, 10, 68/199, 150

[56] References Cited

U.S. PATENT DOCUMENTS

| | | | |
|---|---|---|---|
| 764,966 | 7/1904 | Venter | 68/189 |
| 1,095,796 | 5/1914 | Brandwood | 68/183 |
| 2,238,633 | 4/1941 | Drum et al. | 68/189 |
| 2,792,702 | 5/1957 | Newcomb et al. | 68/189 |
| 3,344,622 | 10/1967 | Kronsbein | 68/189 |
| 3,596,481 | 8/1971 | Wilcox . | |
| 3,960,487 | 6/1976 | Stritzko | 68/150 |
| 4,825,668 | 5/1989 | Villard et al. . | |

FOREIGN PATENT DOCUMENTS

| | | | |
|---|---|---|---|
| 32980 | 6/1928 | France | 68/189 |
| 1018580 | 3/1964 | United Kingdom . | |
| 2062036 | 5/1981 | United Kingdom . | |

OTHER PUBLICATIONS

HotsyTubs 1990 Brochure.

*Primary Examiner*—Frankie L. Stinson
*Attorney, Agent, or Firm*—Shefte, Pinckney & Sawyer

[57] ABSTRACT

An adapter for using a yarn package carrier in both vertically and horizontally oriented treatment vats includes a platform for supporting the yarn package carrier, an assembly for engagement of the adapter by a carrier transfer device and a fluid passageway arrangement formed in the platform for directing treatment fluid from the vertically oriented vat into the yarn package carrier.

15 Claims, 12 Drawing Sheets

ADAPTER FOR USING A HORIZONTAL PACKAGE DYEING CARRIER WITH A VERTICAL TREATMENT MACHINE

CROSS-REFERENCE TO RELATED APPLICATION

This is a continuation-in-part of U.S. patent application Ser. No. 08/049,835 filed Apr. 19, 1993, entitled HORIZONTAL WET TREATMENT MACHINE FOR TEXTILES AND TEXTILE MATERIAL CARRIERS THEREFOR, now U.S. Pat. No. 5,410,892.

BACKGROUND OF THE INVENTION

The present invention relates generally to textile wet treatment machines and, more particularly, to an adapter for using a carrier for supporting packages of textile material during processing in a horizontal wet treatment machine and a vertical treatment machine such as, for example, a vertically oriented dryer.

Textile package dyeing machines normally have a cylindrical pressurizable vessel into which packages of textile material to be wet processed, e.g., yarn packages wound on cylindrical spools, are arranged in vertical stacks on supporting vertical tubes arranged in spaced relation over the interior of the dye vessel. Such dyeing machines basically are of two types, commonly referred to as vertical dyeing machines, i.e., wherein the cylindrical vessel is oriented vertically with an openable lid at the upper end of the vessel for vertical insertion and removal of yarn packages to be dyed, and horizontal dyeing machines, wherein the cylindrical vessel is oriented horizontally with an openable lid at one end for horizontal insertion and removal of yarn packages to be dyed.

In both horizontal and vertical dyeing machines, it is conventional practice to support the yarn packages on a removable carrier which, in the case of vertical machines, can be lifted and lowered and, in the case of horizontal machines, can be horizontally transported on tracks or conveyors, for inserting and removing the yarn packages into and from the dye vessel. Conventional carriers of this type basically comprise a base with a plurality of upstanding tubes mounted in a spaced arrangement to the base. Yarn packages are slidably mounted over the upper ends of the tubes in a stacked arrangement and are secured by a cap threaded onto a compatibly threaded upper end portion of each tube. The upstanding tubes are hollow and perforated and communicate with concentric openings formed through the base to permit dye liquor to flow axially through the tubes and radially through the yarn packages.

Due to the increasing use of both horizontally and vertically oriented machines in textile operations, it is desirable to provide an adapter which will allow a single yarn carrier to be used in both horizontally and vertically oriented treatment machines.

SUMMARY OF THE INVENTION

It is therefore an object of the present invention to provide an adapter for using a yarn carrier in both vertically and horizontally oriented treatment vats which provide sufficient treatment fluid flow for yarn treatment regardless of vat orientation.

It is further an object of the present invention to provide such an adapter which can be easily transferred between the vertically and horizontally oriented vats with the yarn package carrier attached.

To that end, an adapter for Using a yarn package carrier in both vertically and horizontally oriented treatment vats includes a platform for supporting a yarn package carrier, an assembly for engagement of the adapter by a carrier transfer device, said engagement means being mounted to the platform. The present invention further includes a fluid passageway arrangement formed in the platform for directing treatment fluid from the vertically and horizontally oriented vats into the yarn package carrier. Preferably, the platform includes a retaining assembly for retaining the carrier on the platform which includes an assembly for adjusting the retaining assembly to fit carriers of different sizes. It is further preferred that the retaining assembly include at least two plates for abutment with the carrier and the adjustment arrangement includes an assembly attached to one of the plates for drawing the plates closer together with the carrier retained intermediate the two plates.

Typically, vertically oriented vats for applying treatment fluid include a fluid passageway for directing treatment fluid, whether dry air, wash water or dye, upwardly into the vat. The present invention preferably provides an assembly for mating the fluid passageway assembly with a fluid directing assembly in a vertically oriented vat. It is preferred that the mating assembly include a conduit projecting downwardly from the platform in communication with the fluid passageway assembly and matable with an upwardly projecting treatment fluid distribution conduit in a vertically oriented vat.

Further, the present invention preferably includes an assembly for mating the fluid passageway assembly with fluid passageways formed in the carrier. This mating assembly includes a flow directing arrangement to direct fluid flow from the platform through the carrier in a predetermined flow pattern. It is preferable that the two plates from the retaining assembly are used to mate with fluid passageways in the carrier to direct fluid flow in the predetermined pattern.

The adapter of the present invention also preferably includes a roller assembly for supporting and guiding the carrier onto and off of the platform. Preferably, the roller assembly includes a plurality of wheels rotatably mounted to the platform in generally linear alignment.

For the transfer of the carrier between vertically and horizontally oriented vats, an engagement assembly is provided for engaging the adapter with a transfer device associated with the dyeing operations. Preferably, the engagement assembly includes a frame mounted to the platform and projecting upwardly therefrom along the outer periphery of the carrier with the frame including a mating member for engagement by the transfer device. The frame preferably includes a pair of converging rod members disposed on either side of the platform with the rod members being joined at the point of convergence by a horizontally oriented cross member, and the mating member is disposed at approximately the center of the cross member for lifting engagement by the transfer device.

The present invention provides an improvement to a system for the wet treatment of textile material having a dyeing machine with a horizontally oriented and horizontally accessible vat and a treatment machine with a vertically oriented and vertically accessible vat having a fluid delivery apparatus and wherein a carrier is provided for the support of textile material packages thereon for disposition within each vat and including a fluid flow assembly for the flow of treatment fluid to the textile material and wherein a transfer apparatus is provided for the transfer of the carrier between the vats. The improvement includes the aforesaid adapter for supporting the carrier during the transfer thereof between the horizontally oriented vat and the vertically oriented vat and within the vertically oriented vat and includes the above-listed features.

By the above, the present invention provides an adapter that will add versatility to any ongoing dyeing operation, by allowing a single yarn package carrier to be operational in both horizontal and vertical treatment machines without modification. The present invention further allows for enhanced expansion capabilities of any dyeing operation by allowing the use of both vertically and horizontally oriented vats. Therefore, any dyeing operation currently solely reliant on horizontally oriented vats can be adapted to the use of vertically oriented vats. Further, dyeing operations which are now concentrated within vertically oriented vats may be readily expanded to include horizontally oriented vats.

DETAILED DESCRIPTION OF THE PREFERRED EMBODIMENT

Figure 1:
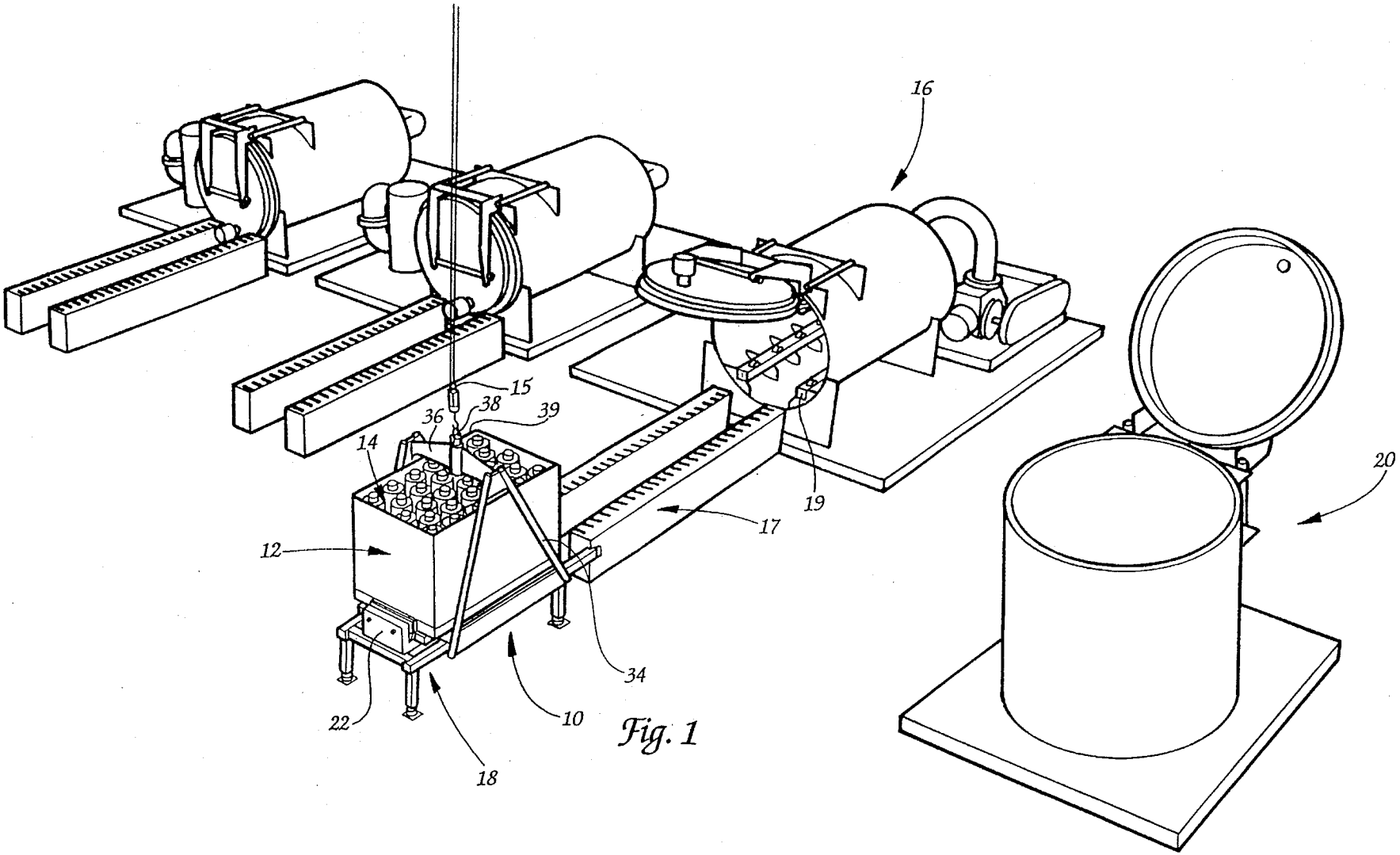
FIG. 1 is a perspective view of the machinery associated with the wet treatment of textile materials illustrating the preferred embodiment of the present invention in the preferred environment.

As illustrated in FIGS. 1–12, an adapter 10 according to he preferred embodiment of the present invention is provided for supporting a carrier 12 which, in turn, supports textile material in the form of yarn packages 14 for transfer to and from horizontal and vertical wet treatment machines in the form of horizontal package dyeing machines 16 and vertical washing, dyeing or drying vats 20. As seen in FIG. 1, the carrier 12 is independently movable on a conventional carrier transport assembly 17 to various locations in a multiple dyeing machine arrangement in which a plurality of dyeing machines 16 are arranged for receiving a plurality of the carriers 12 transported thereto on the carrier transport assembly 17.

According to the present invention, the adapter 10 is configured for movement of the carrier 12 between horizontal dyeing machines 16 and vertical treatment machines 20. FIG. 1 illustrates the adapter 10 holding a carrier 12 on a staging frame 18 in alignment with the transport assembly 17 in front of a horizontal dyeing machine 16. A transfer device 15 is engaged with the adapter 10 in a manner which will be more fully described below for movement of the carrier 12 and its included yarn packages 14 into the vat 20 of a vertical treatment machine. The vertical treatment machine is typically a washer, dryer or other machine for treating yarn packages with treatment fluid. The treatment fluid may be air for drying, wash water, dye or virtually any other fluid for treating textile material.

Figure 2:
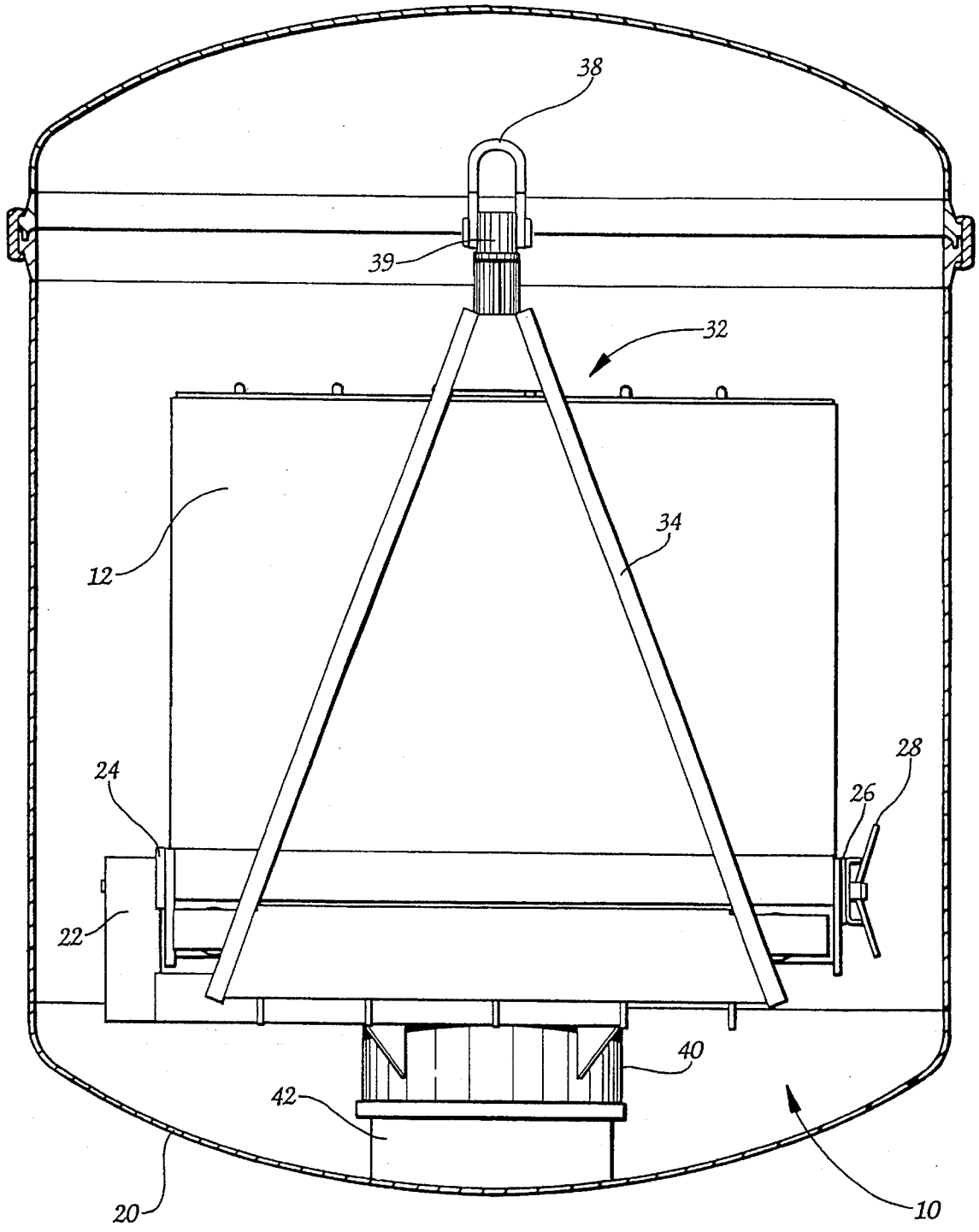
FIG. 2 is a side view of the adapter of the present invention shown mounted in a vertically oriented vat.
Figure 3:
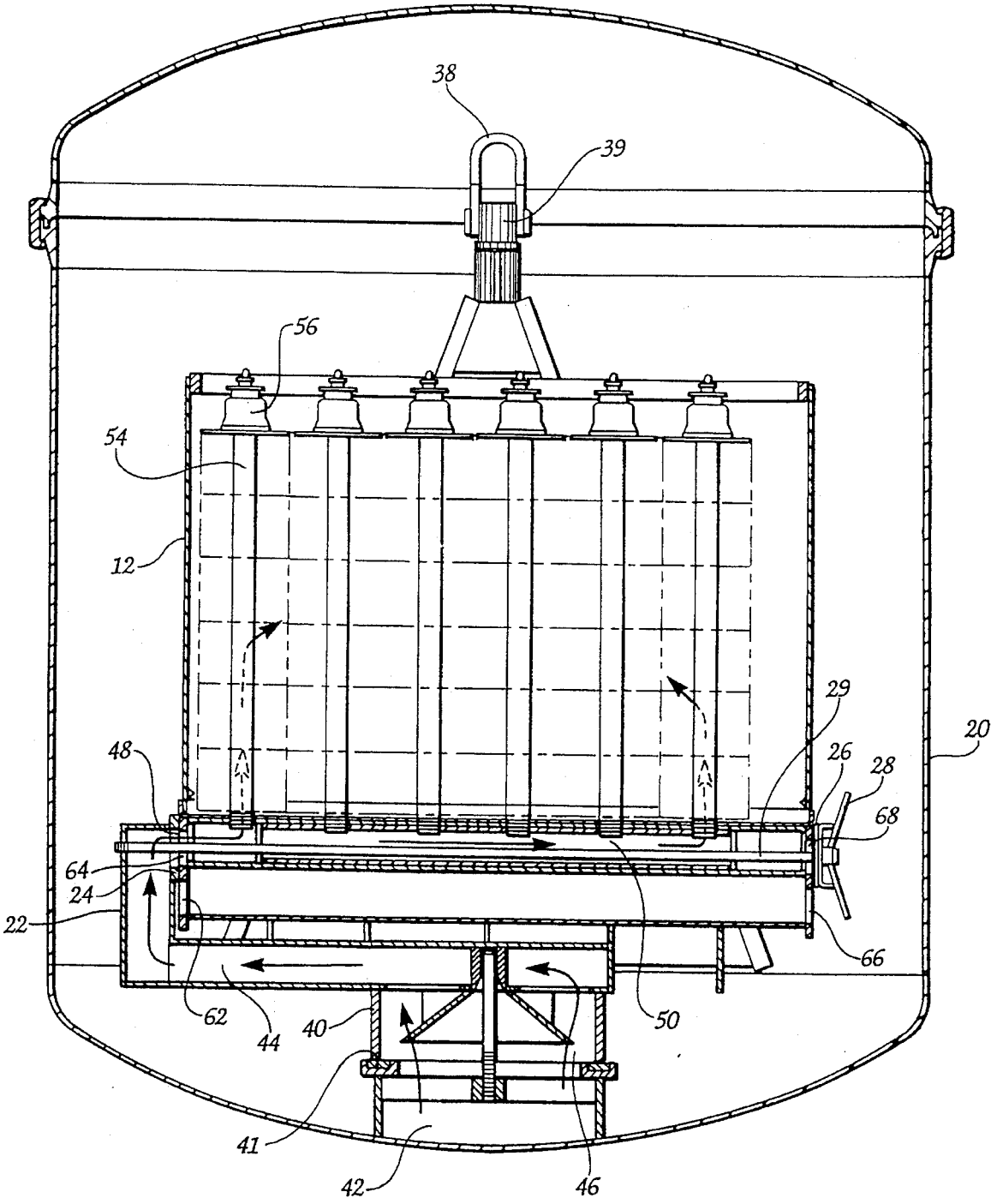
FIG. 3 is a side view of the adapter of the present invention including a yarn package carrier mounted in a vertically oriented vat to illustrate the fluid flow characteristics of the present invention.

As best seen in FIGS. 2 and 3, the vertical vat 20 includes a fluid distribution assembly 42 in the form of a cylindrical member projecting upwardly from the floor of the vat. Since the present application is not directed to a vertically oriented vat, it should be noted that only the description necessary for understanding the present invention and its relation to the vat is included. The adapter 10 includes a generally horizontally oriented rectangular platform 22 which is specifically configured for adaptation to the carrier 12 and the vertically oriented vat 20.

Figure 4:
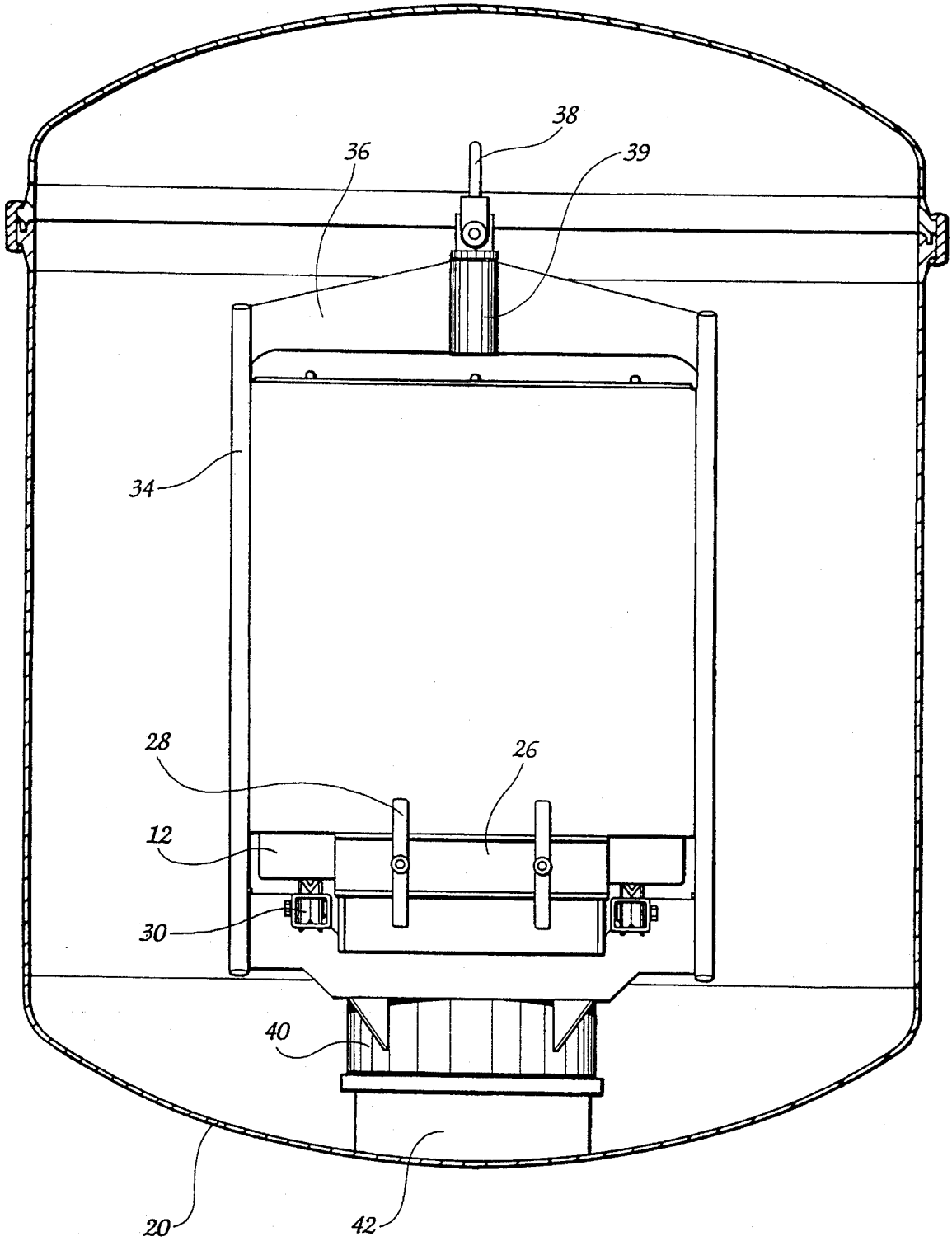
FIG. 4 is a front view of the adapter of the present invention mounted in a vertically oriented vat.
Figure 5:
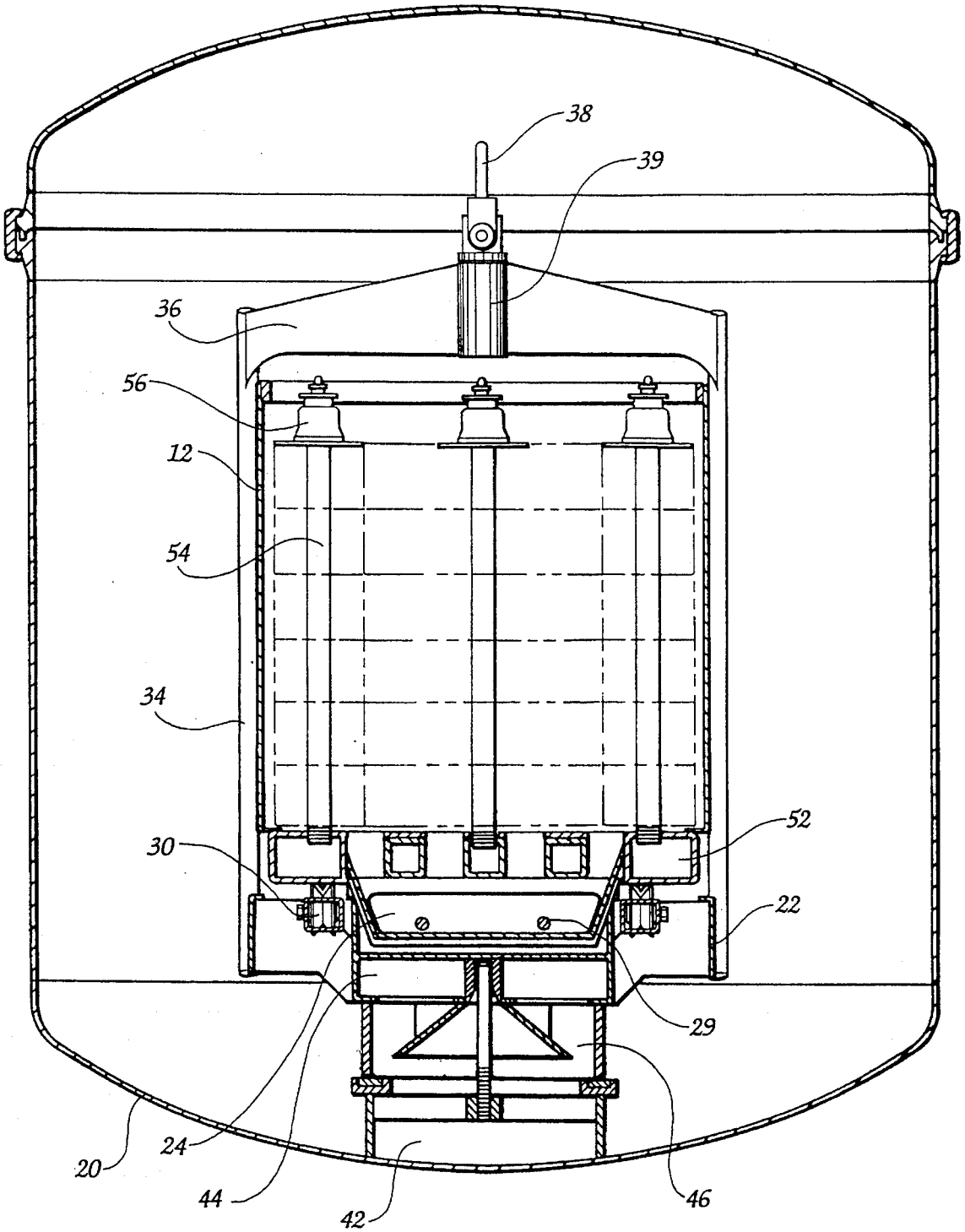
FIG. 5 is a front view of the adapter of the present invention having a carrier mounted thereon and broken open to illustrate the flow passageways illustrated in FIG. 3.
Figure 6:
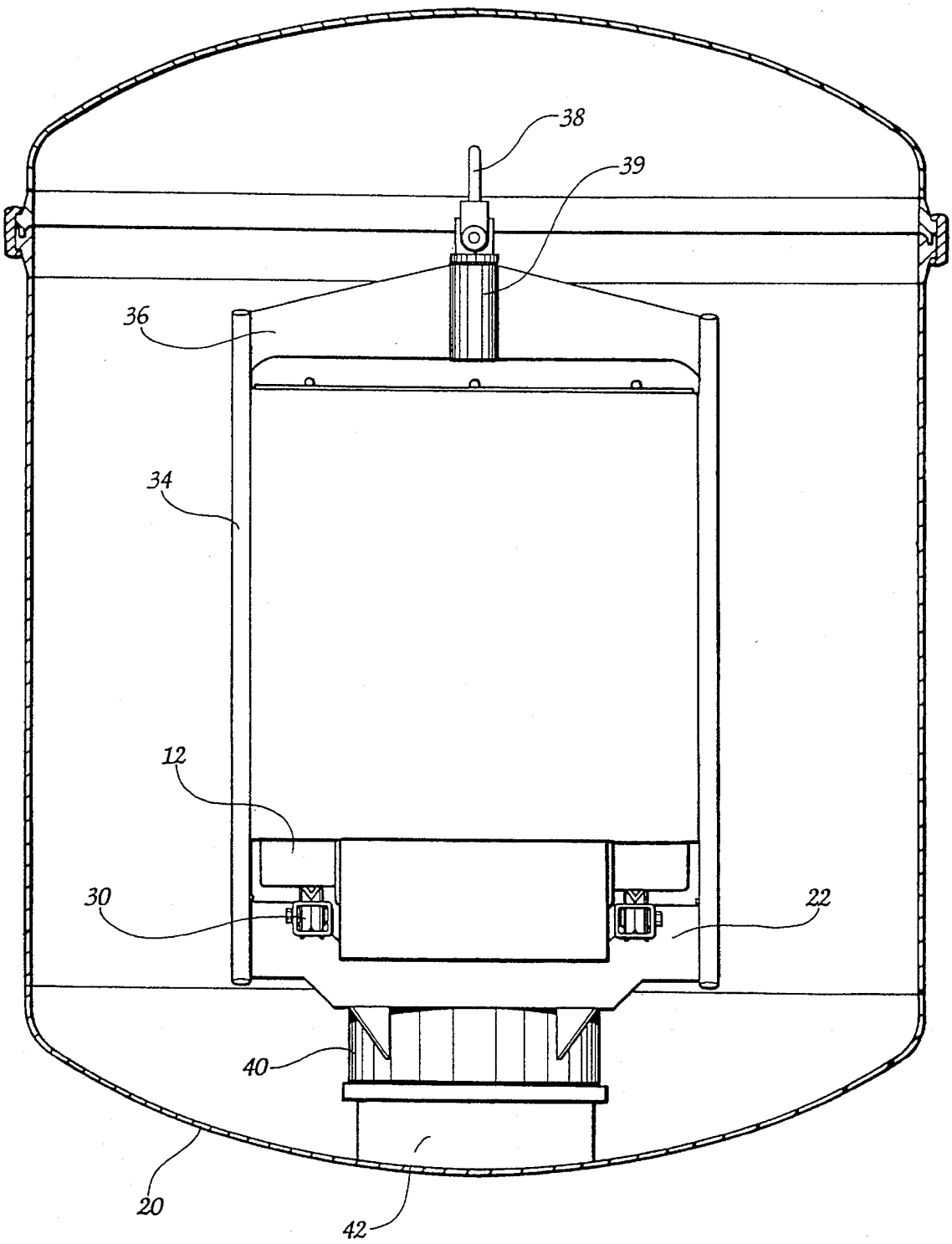
FIG. 6 is a rear view of the adapter of the present invention mounted in a vertically oriented vat.
Figure 7:
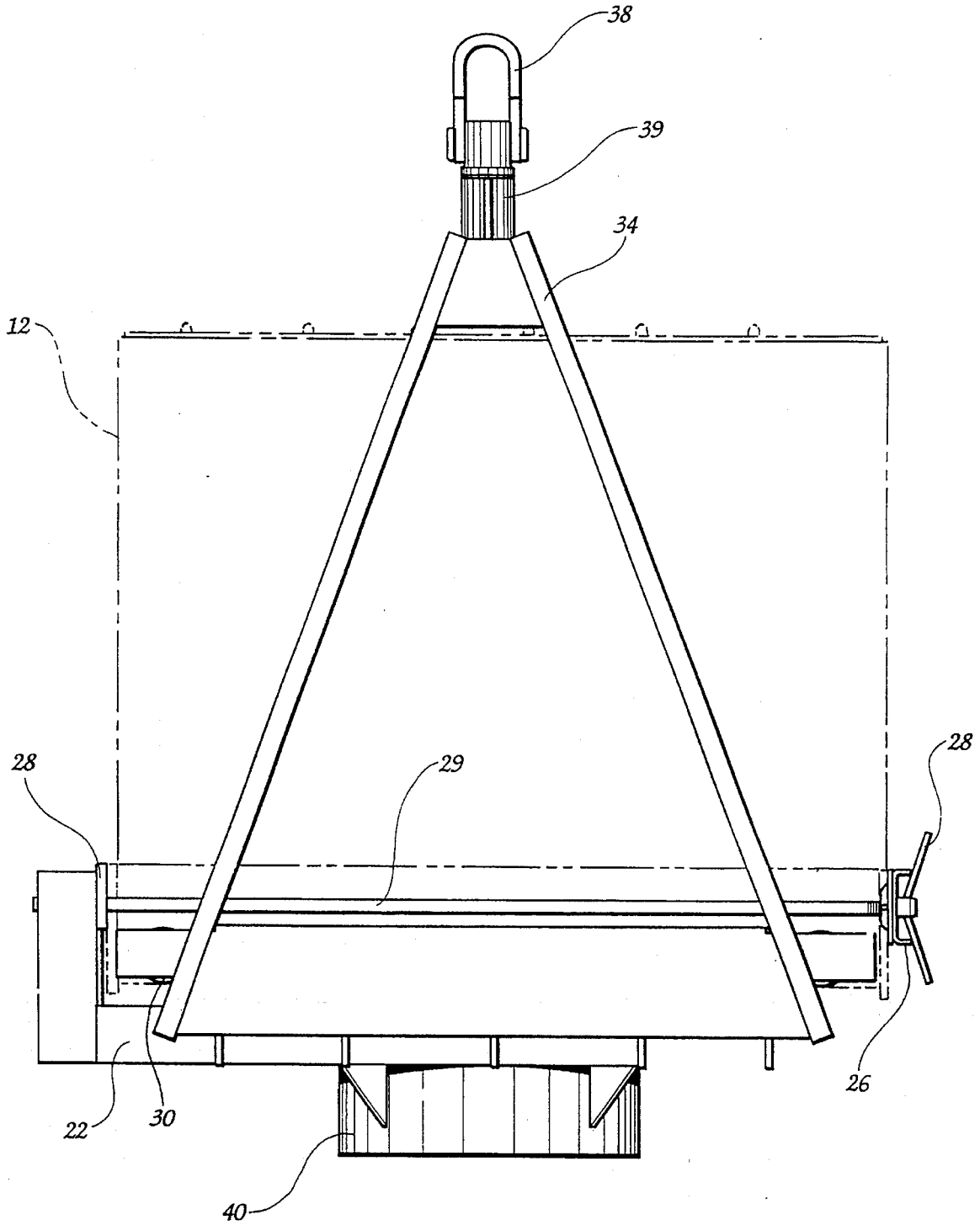
FIG. 7 is a side view of the adapter of the present invention.
Figure 8:
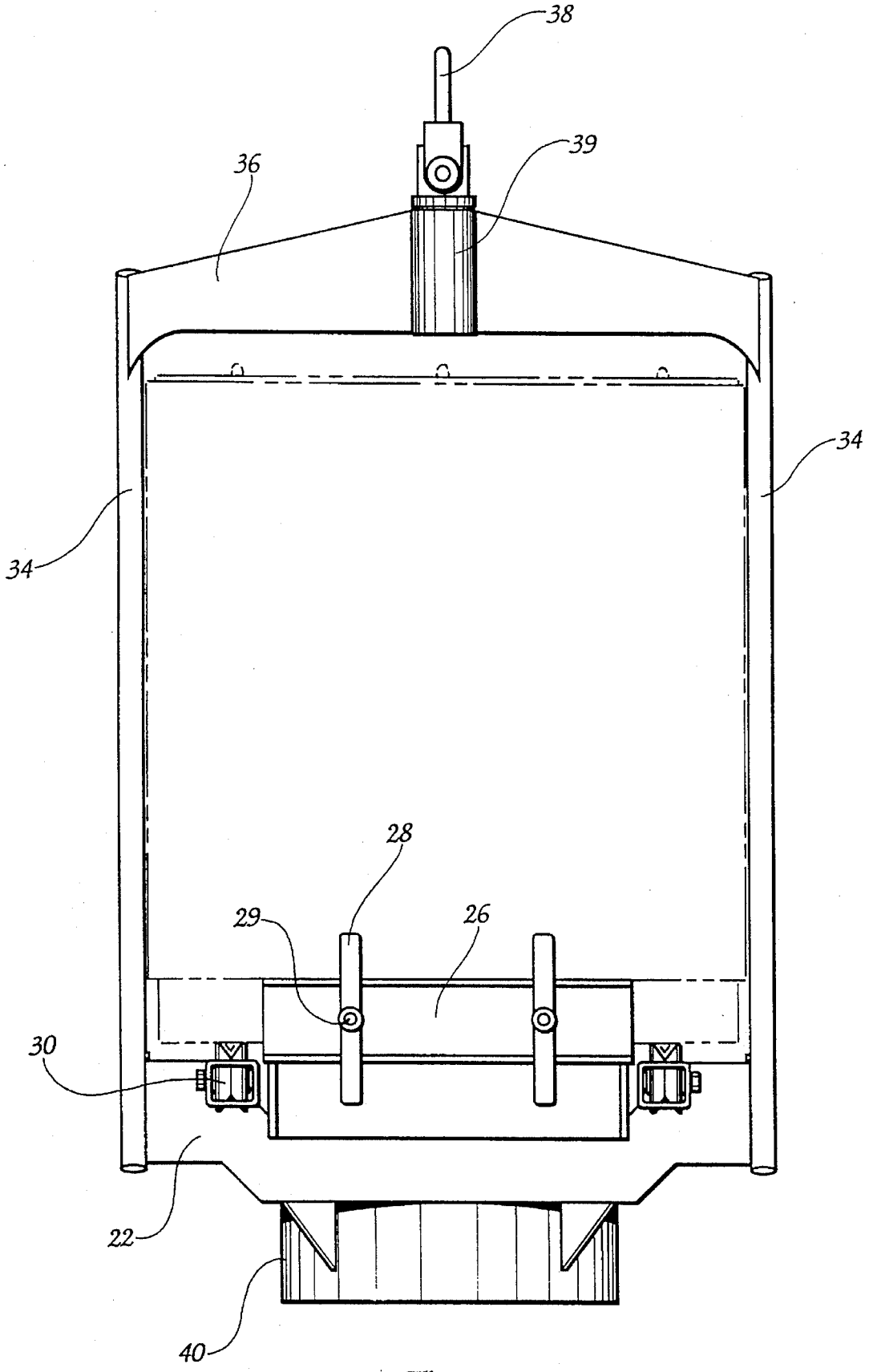
FIG. 8 is a front view of the adapter illustrated in FIG. 7.

In order to retain the carrier 12 on the platform 22, an adjustable retaining assembly is provided including an abutment plate 24 disposed at one end of the platform 22 as seen in FIGS. 2 and 7, a pressure plate 26 as best seen in FIG. 4 and adjusting nuts 28 having wing-like handles projecting outwardly therefrom. As best seen in FIG. 7, an elongate rod member, 29 is welded to the end of the platform 22. The rod member 29 is threaded on an opposite end to mate with the adjusting nuts 28 holding the plate 26 to the carrier 12, extends between the abutment plate 24 and the pressure plate 26 and is engaged with the adjusting nuts 28. Two such rods are provided in generally parallel spaced alignment as illustrated in FIG. 8. As will be seen hereinafter, the pressure plate 26 and the abutment 24 also perform flow directing duties when engaged with the flow passageways in the carrier 12. As seen in FIG. 2, the carrier is fitted intermediate the abutment plate 24 and the pressure plate 26 with pressure applied by turning the adjusting nuts 28 to retain the carrier 12 therebetween.

In order to transport the adapter 10 and carrier 12 between the horizontal and vertical treatment machines, an engagement device is provided for engagement with the transfer device 15 to support the carrier 12 and adapter 10 during the transfer operation. As seen in FIG. 1, the transfer device 15 consists of a hook member extending downwardly from support cables. Turning now to FIG. 2, a support frame 32 includes two upwardly extending support members 34 which form one side of a triangular shaped frame. A similar arrangement is provided on the other side of the platform 22. The support members 34 converge to a junction with a horizontal cross member 36 as best seen in FIG. 4, which extends between two pairs of the vertically oriented support members 34. The carrier 12 may be fitted intermediate the vertical support members 34 and the horizontal cross member 36, which help the retaining assembly stabilize the carrier 12 on the platform 22. In the center of a horizontal cross member 36, a curved engagement member 38 is mounted to an engagement member support 39. The curved engagement member 38 may be acquired by the hook of the transfer device 15 for lifting the adapter 10 and associated carrier 12 from the interior of the vertically oriented vat for movement between the vertically oriented and horizontally oriented vats.

Figure 9:
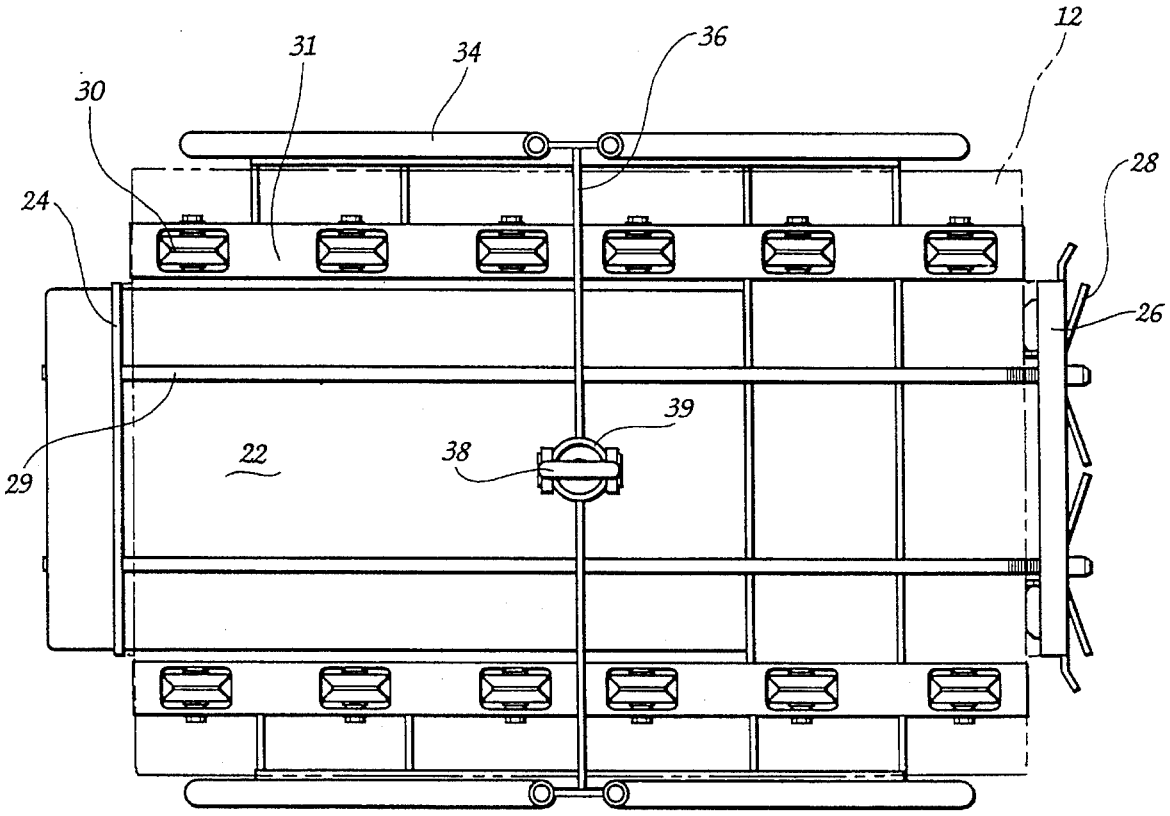
FIG. 9 is a top plan view of the adapter illustrated in FIG. 7.

As suggested by FIG. 1, in order to insert the carrier 12 into a horizontally oriented vat, it is rolled along a transport assembly 14 onto support rails 19 within the horizontal vat. Accordingly, the adapter 10 of the present invention is provided with support wheels 30 mounted to rails 31 to simulate the environment within the horizontal vat. These wheels 30 and their associated rails 31 are best seen in FIG. 9.

Figure 11:
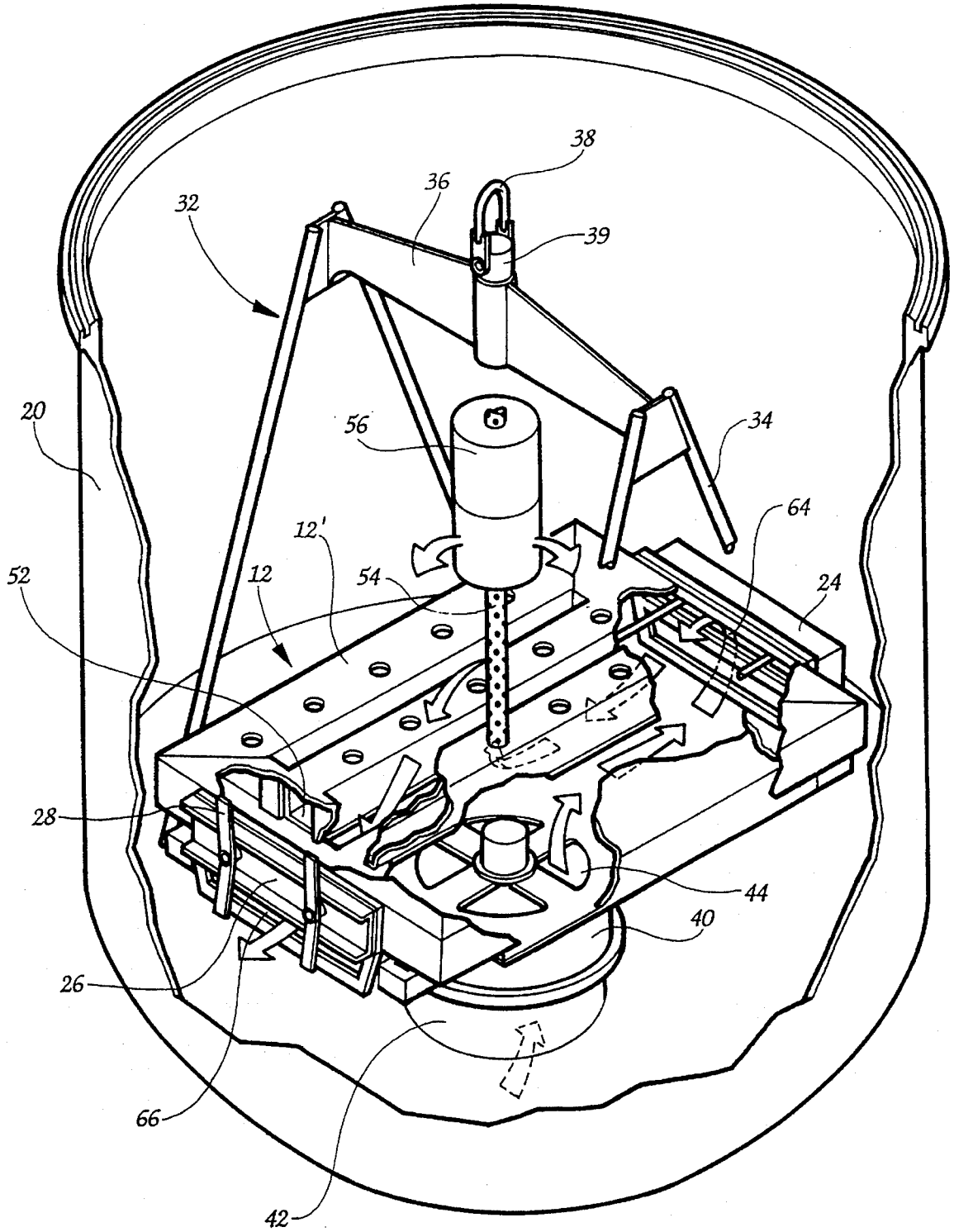
FIG. 11 is a perspective view of the adapter illustrated in FIG. 7 mounted in a vertically oriented vat and including a carrier broken open to display the flow pattern associated with the present invention.

One of the most important aspects of the present invention is its ability to direct fluid flow through the carrier, which is adapted for flow within a horizontal machine, from a vertically oriented treatment machine. As more fully described in parent application Ser. No. 08/049,835, the entirety of which is incorporated herein by reference, the liquid flow arrangement within the carrier is best seen in FIGS. 3 and 11. As disclosed therein, the carrier 12 includes a base 12' which includes a fluid distribution manifold 50 formed therein. A plurality of openings 13 are formed in the base 12' into which are mounted upstanding tubular posts 54 having a plurality of openings formed therein. The yarn packages are fitted over the posts and end caps 56 retain the yarn packages in vertically oriented orientation for treatment. The hollow posts 54 are in communication with the fluid distribution manifold 50 within the base 12'. As is disclosed in the parent application, the carrier preferably includes two chambers arranged one on top of the other for fluid distribution and flow. This chambered arrangement is used in the horizontal dyeing apparatus and is best understood by reference to the parent application.

The adapter of the present application includes fluid passageways 44 formed in the platform 22 which communicate with the fluid distribution manifold 50 of the carrier 12. This passageway 44 directs fluid from the vertical vat distribution assembly 42 upwardly into the carrier for distribution to the textile material within the carrier. This flow pattern is best seen in FIGS. 3 and 11.

Figure 10:
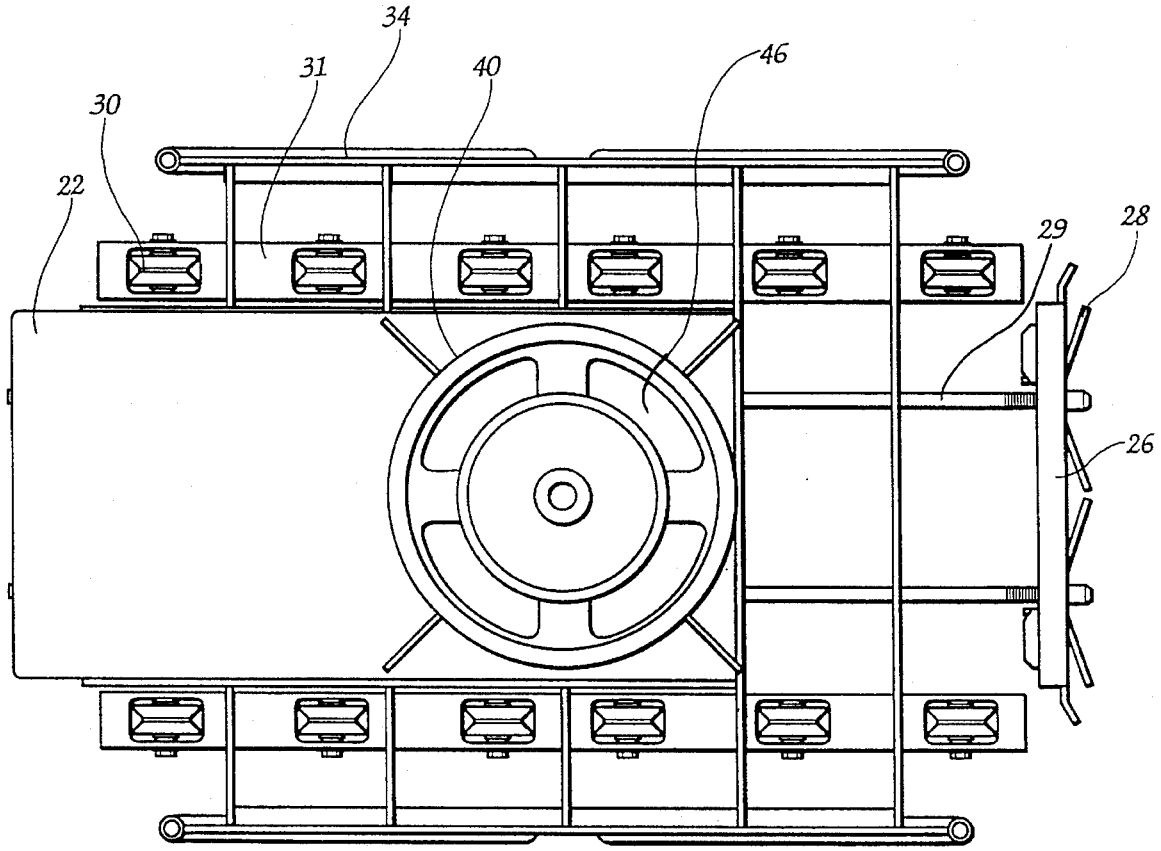
FIG. 10 is a bottom view of the adapter illustrated in FIG. 7.

As seen in FIG. 3, the vertical vat 20 includes a fluid distribution assembly 42 projecting upwardly from the floor thereof. The generally cylindrical mating member 40 projects downwardly from the platform 22 and is adapted to be mated with the fluid distribution assembly 42 at a junction 41. The mating member 40 includes a fluid passageway 46 for passing fluid from the fluid distribution assembly 42 upwardly into the fluid passageway 44 formed in the platform 22. Since the mating member 40 is in approximately the center, underneath the platform 22 as best seen in FIG. 10, the fluid must be directed outwardly to one end of the platform 22 and then upwardly into the carrier 12. Since the carrier includes an inlet and outlet assembly for the free flow of treatment fluid therethrough, the adapter of the present invention uses the aforesaid pressure plate 26 and abutment plate 24 to attach the carrier 12 to the platform at the inlet and outlet thereof.

Since the carrier fluid distribution assembly uses an upper chamber and a lower chamber, and with reference to FIGS. 3 and 11, an upper inlet 64 and upper outlet 68, a lower inlet 62 and a lower outlet 66 are provided. The unique flow directing capabilities of the present invention are provided by closing access to the lower inlet 62 by the platform 22 and closing access to the upper outlet 68 with the pressure plate 26. Therefore, fluid flow is directed from the upper inlet 64 through the distribution manifold 50 and outwardly through the lower outlet 66. As best seen in FIG. 11, the distribution manifold 50 is a series of fluid passageways 52 extending between the openings containing the upstanding fluid distribution posts 54. These flow directing capabilities maintain the carrier flow pattern within the vertical vat.

Accordingly, when used in a vertical vat, the treatment fluid flows upwardly from the fluid distribution assembly 42 through the fluid passageway 46 formed in the mating member 40, around the lower portion of the carrier 12 and upwardly into the upper fluid inlet 64 of the carrier 12 for distribution to the textile packages through the upstanding posts 54. As can be seen in FIG. 11, drainage channels are provided intermediate the posts so that the fluid may drain through the lower fluid outlet 66, disposed below the pressure plate 26 as seen in FIG. 11. Therefore, the adapter of the present invention offers the unique advantage of providing fluid flow through a carrier designed for use in a horizontal treatment vat when used in a vertical treatment vat.

Figure 12:
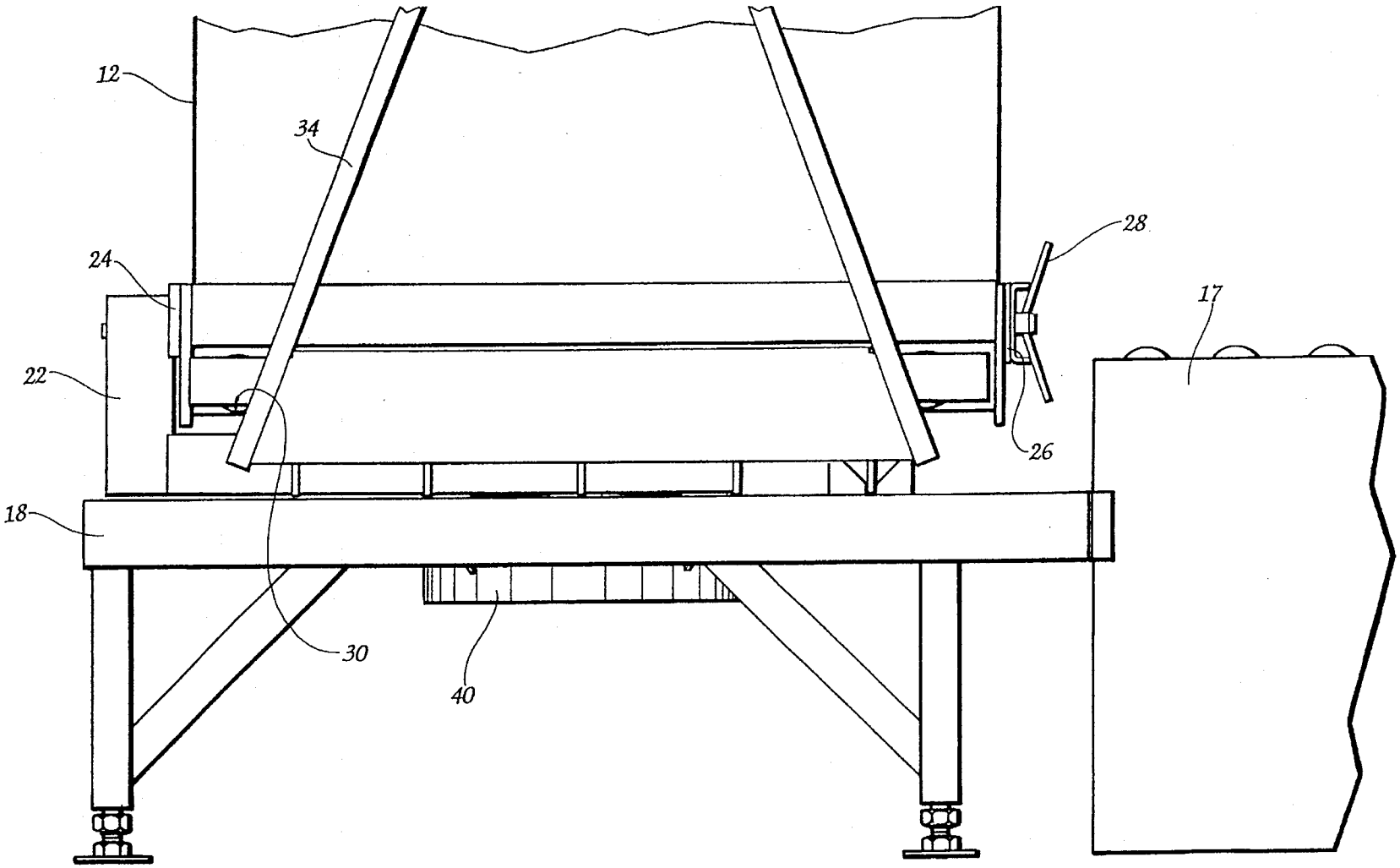
FIG. 12 is a side view of the adapter of the present invention illustrating its use with a horizontally oriented vat.

In operation, and with reference to FIGS. 1 and 12, the carrier 12 is disposed on the staging frame 18 in a position intermediate a vertical vat 20 and a horizontal vat 16. The carrier may be rolled outwardly from the platform onto the carrier transport 17 and onto the support rails 19 within the horizontal vat 16.

After treatment in the horizontal vat 16, the carrier is rolled outwardly along the carrier transport 17 and onto the adapter 10. As discussed previously, the rods 29 are permanent and pass through the platform 22 when rolled onto the adapter 10. The plate 26 is then secured using the wing nuts 28. Once these are tightened, the carrier 12 is retained securely intermediate the abutment plate 24 and the pressure plate 26.

Once the carrier 12 is secured to the adapter 10, the transfer device 15 may be employed to raise the adapter 10 and carrier 12 from the staging platform 18 for transfer into the vertical vat 20. Once at the vertical vat 20, the adapter 10 and carrier 12 may be lowered thereinto and the mating member 40 mated with the fluid distribution assembly 42 of the vertical vat, as seen in FIG. 3. Once supported within the vertical vat, vertical treatment operations may be commenced.

By the above, the present invention provides an adapter for using a carrier associated with a horizontal treatment machine with a vertical treatment machine without modifying the carrier. The adapter provides support for transfer operations as well as providing a fluid flow interface between both the horizontal vat and the vertical vat.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An adapter for using a yarn package carrier in both vertically and horizontally oriented treatment vats comprising a platform for supporting the yarn package carrier, said platform including adjustable retaining means for retaining carriers of different sizes on said platform, means for engagement of said adapter by a carrier transfer device, said engagement means being mounted to said platform and fluid passageway means formed in said platform for directing treatment fluid from the vertically oriented vat into the yarn package carrier.

2. An adapter according to claim 1 wherein said retaining means includes at least two plates for abutment with the carrier and said adjustment means includes means attached to one of said at least two plates for drawing said plates closer together, said retaining means retaining the carrier intermediate said at least two plates.

3. An adapter according to claim 1 and further comprising means for mating said fluid passageway means with a fluid directing assembly in a vertically oriented vat.

4. An adapter according to claim 3 wherein said mating means includes a conduit projecting downwardly from said platform in communication with said fluid passageway means and matable with an upwardly projecting treatment fluid distribution conduit in a vertically oriented vat.

5. An adapter according to claim 1 and further comprising means for mating said fluid passageway means with fluid passageways formed in the carrier.

6. An adapter according to claim 5 wherein said carrier fluid passageway mating means includes flow directing means to direct fluid flow from said platform through said carrier in a predetermined flow pattern.

7. An adapter according to claim 1 and further comprising roller means for supporting and guiding the carrier onto and off of said platform.

8. An adapter for using a yarn package carrier in both vertically and horizontally oriented treatment vats comprising a platform for supporting the yarn package carrier, at least two plates adjustably mounted to said platform for retaining the carrier on the platform, means for engagement of said adaptor by a carrier transfer device, said engagement means being mounted to said platform, fluid passageway means formed in said platform for directing treatment fluid from the vertically oriented vat into the yarn package carrier, and means for mating said fluid passageway means with fluid passageways formed in the carrier, said adjustable plates cooperating with said mating means to direct fluid flow in a predetermined flow pattern.

9. An adapter for using a yarn package carrier in both vertically and horizontally oriented treatment vats, comprising a platform for supporting the yarn package carrier, means for engagement of said adapter by a carrier transfer device, said engagement means being mounted to said platform and including a frame mounted to said platform and projecting upwardly therefrom along the outer periphery of the carrier, said frame including a mating member for engagement by the transfer device and including a pair of converging rod members disposed on either side of said platform, said rod members being joined at the point of convergence by a horizontally oriented cross member, and said mating member being disposed at substantially the center of said cross member for lifting engagement by said transfer device, and fluid passageway means formed in said platform for directing treatment fluid from the vertically oriented vat into the yarn package carrier.

10. In a system for the wet treatment of textile material having a dyeing machine with a horizontally oriented and horizontally accessible vat and a treatment machine with a vertically oriented and vertically accessible vat having a fluid delivery apparatus, and wherein a carrier is provided for the support of textile material packages thereon for disposition within each vat and including a fluid flow assembly for the flow of treatment fluid to the textile material, and wherein a transfer apparatus is provided for the transfer of the carrier between the vats, the improvement comprising an adapter for supporting the carrier during the transfer thereof between the horizontally oriented vat and the vertically oriented vat and within the vertically oriented vat including a platform, engagement means for engagement of said adapter by the carrier transfer apparatus and fluid passageway means formed in said platform for the direction of treatment fluid into the carrier flow assembly from the vat fluid delivery apparatus, said passageway means being configured to mate with the fluid delivery apparatus associated with the vertically oriented vat and the carrier.

11. In a system for the wet treatment of textile material according to claim 10 wherein the vertically oriented vat includes a fluid flow assembly projecting upwardly from the floor of the vat for the flow of treatment fluid upwardly therethrough, said passageway means includes a downwardly projecting conduit matable with the upwardly projecting fluid flow assembly.

12. In a system for the wet treatment of textile material according to claim 10 wherein the carrier fluid flow assembly includes two liquid distribution chambers for delivery of fluid through one of the chambers and withdrawal of fluid through the other of said chambers and said adapter includes flow directing means for blocking the flow of the treatment liquid into one of said chambers and for directing the flow of treatment fluid through the other of said chambers for directing the flow of treatment fluid from the vat fluid flow assembly and into the carrier in a predetermined flow pattern.

13. In a system for the wet treatment of textile material according to claim 12 wherein said frame includes a pair of converging rod members disposed on either side of said platform, said rod members being joined at the point of convergence by a horizontally oriented cross member, and said mating member is disposed at substantially the center of said cross member for lifting engagement by said transfer device.

14. In a system for the wet treatment of textile material according to claim 10 wherein said passageway means includes means matable with said carrier to direct treatment fluid between the upwardly projecting vat fluid flow assembly and the carrier.

15. In a system for the wet treatment of textile material according to claim 10 wherein said engagement means includes a frame mounted to said platform and projecting upwardly therefrom along the outer periphery of the carrier, said frame including a mating member for engagement by the transfer device.

* * * * *

UNITED STATES PATENT AND TRADEMARK OFFICE

CERTIFICATE OF CORRECTION

PATENT NO. : 5,495,730

DATED : March 5, 1996

INVENTOR(S) : Matthew A. Meeker; James K. Turner; Thomas W. Van Scyoc

It is certified that error appears in the above-indentified patent and that said Letters Patent is hereby corrected as shown below:

Col. 2, l. 5, delete "Using" and insert therefor -- using --.

Col. 3, l. 62, delete "he" and insert therefor -- the --.

Col. 4, l. 37, between "member" and "29" delete ",".

Add new claim 16:

-- An adapter according to claim 1 wherein said roller means includes a plurality of wheels rotatably mounted to said platform in generally linear alignment for supporting and directing the carrier onto and off of said platform. --

Signed and Sealed this

Eighteenth Day of March, 1997

*Attest:*

*Attesting Officer*

Bruce Lehman

BRUCE LEHMAN

*Commissioner of Patents and Trademarks*